US009320372B2

(12) United States Patent
Formon et al.

(10) Patent No.: US 9,320,372 B2
(45) **Date of Patent: *Apr. 26, 2016**

(54) STACK OF INTERFOLDED ABSORBENT SHEET PRODUCTS

(71) Applicant: SCA HYGIENE PRODUCTS AB, Gothenburg (SE)

(72) Inventors: John S. Formon, Oxford, PA (US); Frederick R. Albrecht, Dresher, PA (US)

(73) Assignee: SCA HYGIENE PRODUCTS AB, Göteborg (SE)

( * ) Notice: Subject to any disclaimer, the term of this patent is extended or adjusted under 35 U.S.C. 154(b) by 173 days.

This patent is subject to a terminal disclaimer.

(21) Appl. No.: 14/056,586

(22) Filed: Oct. 17, 2013

(65) Prior Publication Data

US 2014/0044917 A1 Feb. 13, 2014

Related U.S. Application Data

(63) Continuation of application No. 12/915,939, filed on Oct. 29, 2010, now Pat. No. 8,597,761.

(51) Int. Cl.

| | |
|---|---|
| ***A47G 11/00*** | (2006.01) |
| ***B65D 83/08*** | (2006.01) |
| ***B65H 45/24*** | (2006.01) |

(52) U.S. Cl.

CPC ..... *A47G 11/001* (2013.01); *B65D 83/0894* (2013.01); *B65H 45/24* (2013.01); *B65H 2701/1924* (2013.01); *Y10T 428/15* (2015.01); *Y10T 428/2419* (2015.01); *Y10T 428/24215* (2015.01); *Y10T 428/24628* (2015.01)

(58) Field of Classification Search

CPC ..... E04C 2/043; B29L 2009/00
USPC ..... 428/124, 121
See application file for complete search history.

(56) References Cited

U.S. PATENT DOCUMENTS

| | | | |
|---|---|---|---|
| 1,427,420 | A | 8/1922 | Sargent |
| 1,632,446 | A | 6/1927 | Kreueger |

(Continued)

FOREIGN PATENT DOCUMENTS

| | | | |
|---|---|---|---|
| SU | 440877 | A1 | 4/1980 |

OTHER PUBLICATIONS

International Search Report dated Feb. 16, 2012, from corresponding PCT application.

(Continued)

*Primary Examiner* — Brent O'Hern
(74) *Attorney, Agent, or Firm* — Drinker Biddle & Reath LLP

(57) ABSTRACT

A stack of interfolded absorbent sheet products comprises a plurality of absorbent sheets each of which is itself folded at least twice about axes that are perpendicular to one another. Each sheet comprises a first fold that is offset from a line parallel to the first fold bisecting the sheet, and a second fold approximately bisecting the sheet in a direction perpendicular to the first fold. Each sheet is folded such that offset portions of the sheet are positioned interiorly of the sheet when folded. The absorbent sheets preferably have an embossed surface relief of a predetermined pattern or design. Each of the absorbent sheets within the stack comprises at least one pair of panels sandwiched between a pair of adjacent panels of another of the absorbent sheets in the stack.

20 Claims, 2 Drawing Sheets

(56) References Cited

U.S. PATENT DOCUMENTS

| | | | | |
|---|---|---|---|---|
| 1,666,553 | A | 4/1928 | Christman | |
| 2,244,630 | A | 6/1941 | Metternich | |
| 3,285,599 | A | 11/1966 | Pherson et al. | |
| 3,291,479 | A | 12/1966 | Greiner et al. | |
| 5,118,554 | A | 6/1992 | Chan et al. | |
| 5,736,224 | A | 4/1998 | Dodge | |
| 5,755,413 | A | 5/1998 | Press | |
| 5,891,008 | A | 4/1999 | Bavely et al. | |
| 6,090,467 | A | 7/2000 | Yip | |
| 6,168,848 | B1 | 1/2001 | Heath | |
| 6,213,346 | B1 | 4/2001 | Skerrett et al. | |
| D462,530 | S | 9/2002 | Almvik | |
| 6,602,575 | B2 | 8/2003 | Lefevre Du Grosriez et al. | |
| 6,623,833 | B2 | 9/2003 | Chan | |
| 6,745,917 | B2 | 6/2004 | Koyama et al. | |
| 7,204,390 | B2 | 4/2007 | Widlund | |
| 7,264,765 | B2 | 9/2007 | Ono et al. | |
| 7,611,765 | B2 | 11/2009 | Hochtritt et al. | |
| 8,597,761 | B2 * | 12/2013 | Formon et al. | 428/124 |
| 2005/0058807 | A1 * | 3/2005 | Hochtritt et al. | 428/126 |
| 2010/0055391 | A1 | 3/2010 | Penfield | |
| 2010/0072219 | A1 * | 3/2010 | Widlund | 221/38 |

OTHER PUBLICATIONS

English-language translation of a Decision on Grant issued Oct. 15, 2015 in corresponding Russian patent application No. 2013124810 (3 pages).

* cited by examiner

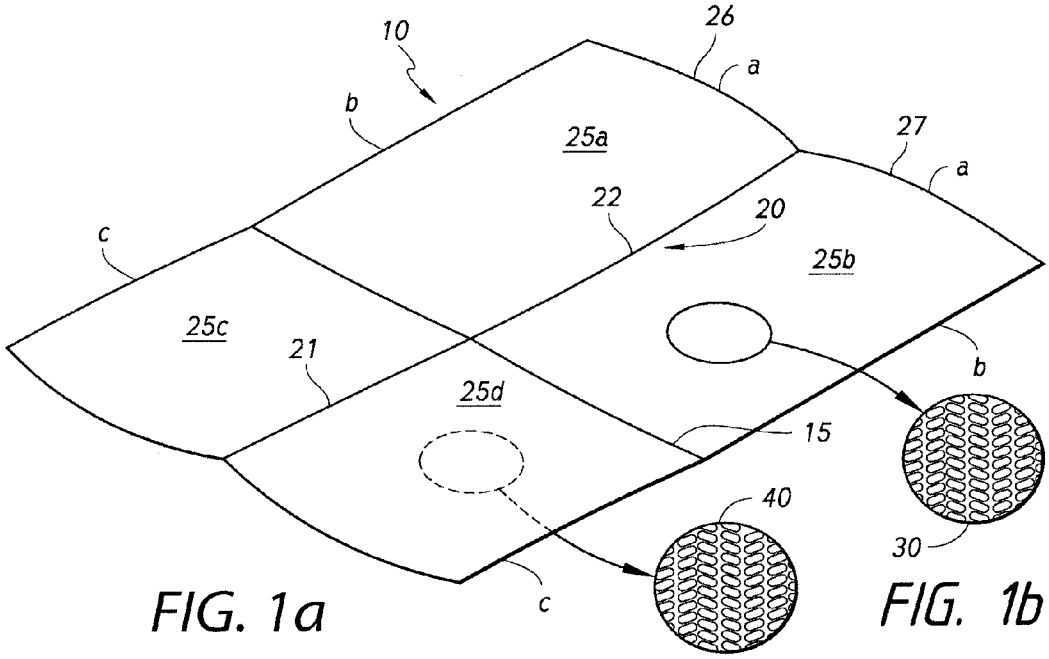
FIG. 1a
FIG. 1b
FIG. 1c
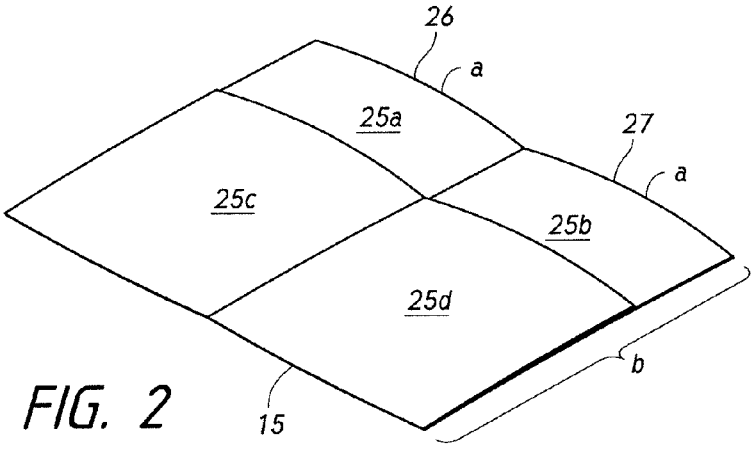
FIG. 2

STACK OF INTERFOLDED ABSORBENT SHEET PRODUCTS

BACKGROUND OF THE INVENTION

1. Field of the Invention

The invention relates to a stack of interfolded absorbent sheet products, and preferably, but not necessarily, to a stack of interfolded paper napkins bearing a predetermined pattern imparted by embossing or by formation by Through-Air Drying ("TAD") or by a structured tissue technique.

2. Description of Related Art

In commercial food service establishments and public restrooms, folded paper products such as paper napkins are typically provided in dispensers from which the products may be withdrawn by the patrons of those establishments. Whereas the highest quality paper napkins are invariably "server-controlled," i.e., delivered individually by a waiter or waitress, it is nevertheless desired to provide paper products in the user-dispensed application that are perceived as being of relatively higher quality.

Interfolded paper products, and especially interfolded paper napkins, have the advantage that they can be loaded into a dispenser whose faceplate cooperates with the stack of napkins to encourage users to remove napkins one at a time. This results in users taking fewer napkins than if it were possible or encouraged to remove a group of napkins simultaneously, although the paper product stack according to the invention may be used in dispensers that promote either one at a time or group dispensing.

Interfolded paper napkins applied to a user-dispensed environment include those that are single folded only. Patent literature describes a variety of arrangements of interfolded paper napkins having plural parallel folds, for example, in U.S. Pat. Nos. 5,118,554, 6,090,467 and 6,213,346.

Paper napkins that are single folded only (sometimes also called "half-folded" when the fold bisects the napkin, or "off-folded" when it does not) have the disadvantage that, in order to achieve a given total absorbency, the basis weight of the unfolded napkin sheet must be relatively high. This in turn causes the napkin to have relatively low softness and drape properties, both of which properties are important to the user's perception of the total quality of the napkin. The provision of plural parallel folds in a napkin has the obvious limitation that the napkin will have a relatively elongated shape in the direction parallel to the folds, unless the starting blank is cut to a relatively more elongated shape in the direction perpendicular to the folds.

Such interfolded paper napkins also include those that are folded at least twice about axes that are perpendicular to one another, as described in commonly-owned U.S. Pat. No. 7,611,765, the entirety of which patent is hereby expressly incorporated by reference. In embodiments of that patent wherein two folds each bisect the base napkin sheet, the area of the unfolded sheet will be approximately four times that of the folded napkin.

U.S. Published Patent Application No. 2010/0055391 describes an array of folded sheet materials in which each sheet is first folded along a "medial" fold and then folded in a perpendicular direction in an "off-fold" location. However, an interfolded stack of such materials is subject to certain limitations as regards its appearance and dispensing, as discussed herein.

SUMMARY OF THE INVENTION

It is therefore an object of the invention to address and alleviate, at least in part, the disadvantages described above in connection with the related art, by providing a stack of interfolded absorbent sheet products, each of which products is itself folded at least twice about axes that are perpendicular to one another, the products moreover preferably but not necessarily comprising a surface relief of a predetermined pattern or design imparted by embossing or by TAD or structured tissue formation.

The folded absorbent sheet products according to the invention comprise a first fold that is deliberately offset from a parallel line bisecting the sheet, and a second fold that preferably bisects the sheet in the perpendicular direction.

The folded absorbent sheet products according to the invention are preferably single ply paper napkins having a basis weight of from about 10 to 20 lb per unfolded sheet. More preferably, the basis weight of the napkins according to the invention is from about 11 to about 17 lb, still more preferably from about 12 to about 15 lb, and most preferably about 13 lb. The expression of basis weight in pounds as used herein is with reference to a stack of 500 unfolded single ply sheets each measuring 24 by 36 inches.

The term "absorbent sheet products" as used herein embraces not only paper products such as paper napkins, but also absorbent nonwoven materials not normally classed as papers or tissues. Such nonwoven materials include pure nonwovens and hybrid nonwoven/pulp webs whose properties are similar to those of tissue paper, but which are based for example on nonwoven or airlaid materials containing low amounts of synthetic fibers, binders, wet strength agents and the like. An example of such a material would be a wetlaid or foam-formed hydraulically entangled nonwoven material comprising at least 30% by weight pulp fibers and at least 20% by weight manmade fibers or filaments.

BRIEF DESCRIPTION OF THE DRAWINGS

Other objects, features and advantages of the invention will become more apparent after reading the following detailed description of preferred embodiments of the invention, given with reference to the accompanying drawings, in which:

FIG. 1(*a*) is a perspective view of an individual unfolded napkin according to a first embodiment of the present invention;

FIG. 1(*b*) is a detail depicting an embossing pattern applied to the obverse side of the napkin of FIG. 1(*a*);

FIG. 1(*c*) is a detail depicting an embossing pattern applied to the reverse side of the napkin of FIG. 1(*a*);

FIG. 2 is a perspective view of an individual napkin according to the embodiment of FIG. 1(*a*) the present invention, in which only the second fold has been unfolded;

FIG. 4(*b*) is a schematic cross-sectional view of the napkin stack of the FIG. 4(*a*) embodiment.

DETAILED DESCRIPTION OF PREFERRED EMBODIMENTS

Figure 3:
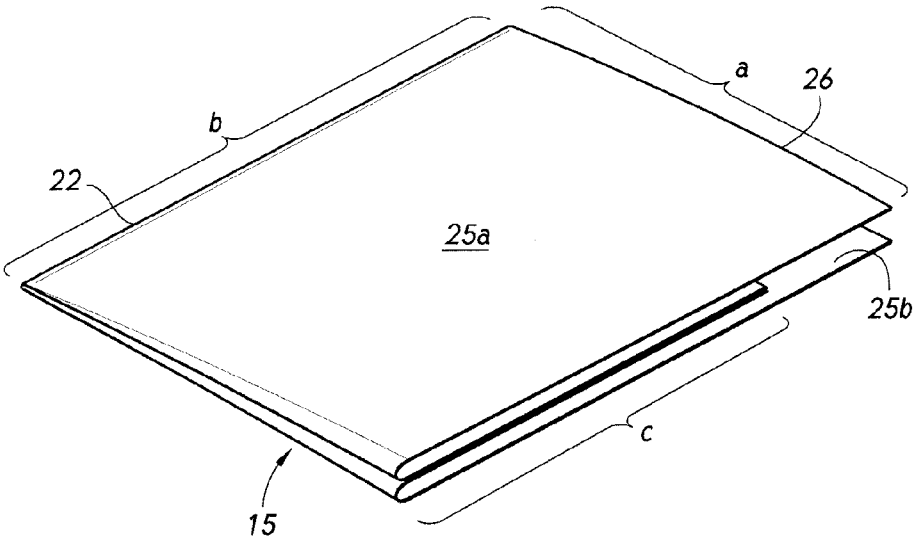
FIG. 3 is a perspective view of an individual napkin according to the embodiment of FIG. 1(*a*) the present invention, in which neither fold has been unfolded.

In FIG. 1(*a*), a sheet of absorbent material 10 is depicted that has been folded according to the invention and then unfolded. The sheet of absorbent material in this embodiment, prior to folding, preferably has dimensions of approximately 8.5"×11". However, those dimensions may of course be varied to suit the particular desired application of the product.

The sheet 10 is first folded along a fold 15, and then folded a second time along a fold 20 that is perpendicular to the fold 15. The fold 15 is parallel to the short sides of the sheet 10, and so in this embodiment has a length of 8.5". When the absorbent sheet is a non-square rectangle, the first fold is preferably parallel to the short sides of the rectangle, and thus perpendicular to the long sides. The first fold 15 is deliberately offset from the line parallel to it that would bisect sheet 10. In this case, the fold 15 is offset by approximately 2" from that line, so that the length of the sheet 10 in this embodiment is approximately 6.5" from fold 15 to the far short side of sheet 10 (denoted "b" in FIG. 1*a*), and approximately 4.5" from fold 15 to the near short side of sheet 10 (denoted "c" in FIG. 1*a*). The fold 15 will typically be located such that the length "b" will be at most about three times the length "c", and at least about 1.1 times the length "c". Preferably, the length "b" is at most twice the length "c" and at least 1.3 times the length "c".

The location of the first fold 15 can also be considered in terms of the extent of offset between the two panels created by that fold, which is to say the difference between the dimensions "b" and "c", and, more particularly, the ratio of (b−c) to (b+c), which expresses the offset relative to the total sheet length. That ratio in the present embodiment is about 0.18 ((6.5−4.5)/(6.5+4.5)). More generally, that ratio is preferably at least about 0.05 and at most about 0.48, and more preferably in the range from about 0.10 to about 0.33.

The second fold 20 substantially bisects the sheet 10, thus defining lengths "a" which in this embodiment are each approximately 4.25". The panel edges of length "a" on the far short side of sheet 10 are designated 26 and 27 in FIG. 1*a*.

As the panel width "a" is half the width of the shorter side of the unfolded absorbent sheet (when the sheet is other than square), the length of "a" will be at most half of the sum of the lengths of "b" and "c". When the unfolded sheet is a non-square rectangle, its width is nevertheless preferably greater than half of its length, and therefore the length of "a" will preferably be at least one quarter of the sum of the lengths of "b" and "c".

The folds 15 and 20 thus define four panels 25*a*, 25*b*, 25*c* and 25*d*, wherein panels 25*a* and 25*b* in this embodiment each have dimensions of approximately 6.5"×4.25", whereas panels 25*c* and 25*d* each have dimensions of approximately 4.5"×4.25".

Folds 15 and 20 are referred to herein as the "first" fold and "second" fold, respectively. That designation refers not only to the sequence in which the folds are applied, but also to the shape of the folds themselves. In particular, fold 15, being the first fold, is unidirectionally peaked. Thus, with reference to FIG. 1*a*, the panels 25*a* and 25*b* of the unfolded sheet 10 as seen in that view are both slightly inclined upwardly from fold 15, and so too are the panels 25*c* and 25*d*.

On the other hand, fold 20, being the second fold, is oppositely peaked, which is to say that when the sheet 10 is unfolded, the panels 25*a* and 25*b* of the unfolded sheet 10 are slightly inclined upwardly from the portion 22 of fold 20 that extends from fold 15 to the far short side of sheet 10, whereas the panels 25*c* and 25*d* of the unfolded sheet 10 are slightly inclined downwardly from the portion 21 of fold 20 that extends from fold 15 to the near short side of sheet 10 when unfolded.

The absorbent sheets according to the invention may be of a variety of types, including, without limitation, dry crepe tissue; wet crepe tissue; creped TAD (through air dried) tissue; uncreped TAD tissue; structure or textured tissue, made using a process including the step of using pressure, vacuum, or air flow through the wet web (or a combination of these) to conform the wet web into a shaped fabric and subsequently drying the shaped sheet using a Yankee dryer, or series of steam heated dryers, or some other means, including but not limited to tissue made using the ATMOS process developed by Voith or the NTT process developed by Metso; fabric creped tissue, made using a process including the step of transferring the wet web from a carrying surface (belt, fabric, felt, or roll) moving at one speed to a fabric moving at a slower speed (at least 5% slower) and subsequently drying the sheet. Those skilled in the art will recognize that these processes are not mutually exclusive, e.g., an uncreped TAD process may include a fabric crepe step in the process.

The absorbent sheets according to the invention are preferably embossed, particularly when they are in the form of paper napkins the paper of which is formed on a traditional Yankee cylinder/dry crepe forming line. As used herein, the term "embossed" connotes a three-dimensional low relief pattern of a distinct pattern or image. Such embossing may be applied by conventional embossing rollers during the converting phase of the napkin manufacturing, preferably upstream of the folding and interfolding, and/or may be formed by a selected pattern of the TAD fabric, if the napkins are made by the TAD technique. Similarly, the term embossing as used herein may embrace the pattern imparted to structure or textured tissue by the textured papermaking fabrics used to make them, regardless of whether the textured papermaking fabrics include additional distinct design elements (see, for example, U.S. Pat. No. 7,624,765). The term "embossed" as used herein does not embrace, however, any incidental surface roughness imparted to a napkin sheet by the forming fabric used in a traditional Yankee cylinder/dry crepe forming line, which surface roughness does not display any predetermined pattern to the unaided eye.

When the absorbent sheets according to the invention are embossed during a converting phase utilizing embossing rollers, the embossing rollers will preferably be of the type in which one roller bears a male pattern comprising all or a majority of projecting embossing elements, and the other roller bears a female pattern comprising all or a majority of cooperating recessed embossing elements.

In FIG. 1*b*, a detail is shown of the obverse side of sheet 10, illustrating an embossing pattern comprising a multitude of relief elements 30 that project from the undisturbed plane of sheet 10. Elements 30 thus form the "male" side of the embossed sheet 10, and are consequently formed by the sheet 10 passing between embossing rollers with the obverse side in contact with the female roller.

Conversely, in FIG. 1*c*, a detail is shown of the reverse side of sheet 10, illustrating an embossing pattern comprising a multitude of relief elements 40 that are recessed from the undisturbed plane of sheet 10. Indeed, relief elements 30 and 40 are typically the same structure, as viewed from opposite sides of the sheet 10. Elements 40 thus form the "female" side of the embossed sheet 10, and are consequently formed by the sheet passing between embossing rollers with the reverse side in contact with the male roller.

It is preferred to form folds 15 and 20 such that the male projections 30 are located on the inside of the folded napkin, and the female recesses 40 are on the outside of the napkin. This folding orientation in relation to the sidedness of the embossing pattern serves to provide an improved hand-feel for the outer surfaces of the napkin, while providing the improved absorbency due to the embossing.

Thus, with reference to FIG. 1*a*, fold 15 is formed such that the obverse sides of panels 25*c* and 25*d* lay upon the obverse sides of panels 25*a* and 25*b* (as shown in FIG. 2).

In the case of TAD tissue or structure or textured tissue, the folding of the sheets is preferably effected such that the air side of the sheets is located on the inside of the folded napkin as described above in connection with the male projections, with the fabric side of the sheets then being on the outside surfaces of the folded napkin as described above in connection with the female recesses 40.

The specific pattern embossed onto the napkins according to the invention may vary according to the application of the invention, with that illustrated in commonly-owned U.S. Design Patent No. D462,530 being one possibility. The embossing may be of a continuous pattern over the entire surface of the sheet, as is the case for FIG. 6, or the embossing may be applied only to selected regions of the sheet, e.g. along a periphery or a border thereof.

When the absorbent sheets according to the invention are to be used in a commercial establishment, such as a fast-food restaurant or a convenience store, it may be desirable for the napkins to bear the name and/or the logo of the establishment in which the napkins will be dispensed. In that case the name and/or logo may be formed by embossing, or by printing the napkin with an ink that sufficiently contrasts with the color of the paper stock, or by a combination of those techniques.

In FIG. 2, the napkin of FIG. 1*a* has been unfolded along fold 20, but not along fold 15. Thus, panels 25*c* and 25*d* visible in FIG. 2 are on the reverse side of sheet 10, and bear the female embossments 40, whereas the portions of panels 25*a* and 25*b* visible in FIG. 2 are on the observe side of sheet 10 and bear the male embossments 30. As the only obverse surfaces then exposed are the portions of panels 25*a* and 25*b* not covered by the smaller panels 25*c* and 25*d,* fold 20 is formed so as to bring those exposed panel portions into contact, such that the fully folded napkin has the appearance shown in FIG. 3.

It will be appreciated that in the fully folded napkin only the reverse sides of panels 25*a* and 25*b* are substantially visible, with only the reverse side of panel 25*a* being substantially visible in FIG. 3. The edge regions of the napkin as illustrated in FIG. 3 are somewhat exaggerated for ease of understanding, but those skilled in the art will recognize that their appearance will be much less prominent in actual practice. Thus, the outward side of the napkin not shown in FIG. 3, i.e., the reverse side of panel 25*b,* is substantially the mirror image of that shown. Consequently, a user holding the folded napkin will touch substantially only the recessed embossments 40.

Significantly, this folding configuration also conceals the unequal sizes of panels 25*a* and 25*b* relative to panels 25*c* and 25*d,* because the offset between those panels shown in FIG. 2 is not substantially visible to a user when the napkin is further folded about fold 20 in the manner shown in FIG. 3. It is also possible to form fold 20 with the opposite peakedness, such that the overlapping regions would be exposed on both sides of the fully folded napkin.

Similarly, fold 15 could be formed with the opposite peakedness to that shown in FIG. 1*a*, with the result that the male embossments would be exposed on the outer surfaces of the fully folded napkin.

The ability of the folding configuration according to the present invention to conceal the offset fold is in contrast to the folded sheet materials described in U.S. Published Patent Application No. 2010/0055391. There, because the bisecting fold is formed first and the offset fold is formed second, the offset will always be outwardly visible in the fully folded sheet, regardless of whether the folds are formed to bring together the obverse or reverse surfaces of the sheet.

The fully folded napkin illustrated in present FIG. 3 thus has dimensions of approximately 6.5"×4.25". Those are the same dimensions of the fully folded napkin in the preferred quarter-folded embodiment of commonly-owned U.S. Pat. No. 7,611,765; however, in commonly-owned U.S. Pat. No. 7,611,765 the base napkin sheet has dimensions of approximately 8.5"×13", whereas the base napkin sheet of the present embodiment has base dimension of only about 8.5"×11". The present embodiment therefore provides a product that, at least in its fully folded configuration, is visually indistinct from the preferred napkin described in the earlier patent, yet which is made with about 15% less paper. Moreover, as the thinner part of the folded napkin occurs over only a minority of the length of the longer side thereof, the tactile perception and performance of the napkin is not significantly affected.

Figure 4B:
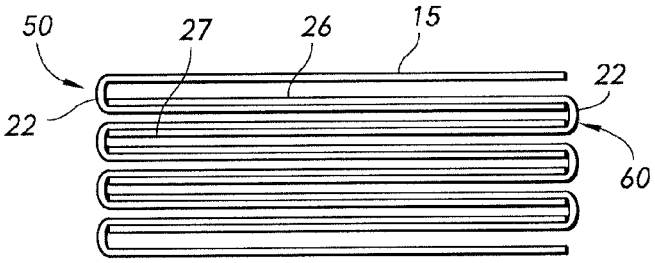
FIG. 4(*a*) is a schematic representation of the interfold configuration of a stack of folded absorbent sheet products according to the embodiment of FIG. 1(*a*)
Figure 4A:
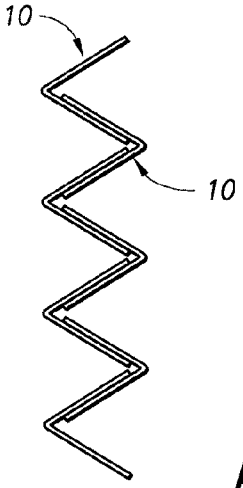

FIG. 4(*a*) depicts schematically the manner in which the folded sheets of the invention may be interfolded to form a stack of folded and interfolded sheets according to the invention. As seen in FIG. 4(*a*), the interfolding of adjacent sheets is such that any given napkin within the stack receives, between a pair of adjacent panels of the given napkin, a pair of adjacent panels of each of an upper and a lower napkin within the stack.

Such an interfolding arrangement is shown in the context of single folded paper towels, in U.S. Pat. Nos. 1,427,420 and 1,632,446. A quarter-fold interfolded napkin is described in commonly-owned U.S. Pat. No. 7,611,765. Web interfolding machines are described in U.S. Pat. Nos. 3,285,599 and 3,291,479, the entireties of which patents are hereby expressly incorporated by reference.

In FIG. 4(*b*) it can be seen that the napkins as interfolded within the stack alternate between napkins 50 oriented as in FIG. 3, with the fold 15 being visible in the plane of the page, and napkins 60 oriented as if the napkin of FIG. 3 were rotated 180° about an axis perpendicular to the napkin sheet, such that edges 26 and 27 of napkins 60 are visible in the plane of the page.

The interfolding arrangement depicted in FIGS. 4(*a*) and 4(*b*) thus reveals another significant advantage of the folding arrangement according to the present invention, in that the overlapping panels of adjacent napkins are all of equal width "a" in the direction of interfolding. This is again in contrast to an arrangement as described in U.S. Published Patent Application No. 2010/0055391, wherein the folding configuration requires that in the interfolded stack of sheets each sheet will overlap unequally with each adjacent sheet. Consequently, when the stack is loaded into a dispenser in one direction, the emergence of a next sheet upon dispensing of an upstream sheet will require that a short panel pair pull out a long panel pair despite only partial overlap between the panel pairs, whereas when the stack is loaded in the other direction the leading edge of each next sheet will be the short panel pair, which affords users only a reduced grasping area with consequent risk of cross-contamination of the dispenser surfaces.

By contrast, in the stack of interfolded napkins as depicted in FIGS. 4(*a*) and 4(*b*), there is no difference between the top of the stack and the bottom, in that the napkins will be dispensed the same way whether the stack is loaded into a dispenser top up or bottom up.

As noted above, when the absorbent sheet products according to the invention are to be used in a convenience store or a food establishment, particularly a fast food franchise, it is contemplated that the embossing might take the form of a logo of the store or restaurant in which the napkins will be used, either alone or in combination with a decorative border.

The basis weight of the absorbent sheet products according to the invention is preferably within the range of a high quality napkin, and thus less than that of commercially available single folded paper products, whose higher basis weight places them closer to the category of paper towels. Preferred embodiments have a basis weight of about 13 lb, calculated as defined above. However, it will be appreciated by those skilled in the art that the basis weight may vary over a broader range, from about 10 to 20 lb per unfolded sheet, more preferably from about 11 to about 17 lb, and still more preferably from about 12 to about 15 lb.

While this range of basis weights is greater than that commonly used for facial tissue (wherein a basis weight of 8½ to 9 per ply is typical), it is distinctly less than the basis weights found in commercially available single-fold napkin/towels, which tend to have basis weights in excess of 20 lb. Thus, by providing a paper napkin wherein the sheet has a relatively low basis weight, yet the napkin is folded to have at least four panels, the invention provides a napkin that is comparatively softer and has improved drape properties in relation to single fold products.

The folded absorbent sheet products according to the invention are preferably discrete, that is, entirely detached from one another. However, it is also within the scope of the invention that the stack of absorbent sheet products be interconnected by "tabs", with the pulling force at the time of withdrawing a single absorbent sheet product through a dispensing opening being greater than or equal to the force required to tear the tabs connecting adjacent absorbent sheet products.

When the products are interconnected by tabs, the interfolding arrangement described herein recommends that the stack of absorbent sheet products be formed in a pair of parallel "lanes", such that, it is in fact alternate absorbent sheet products that are joined together, rather than consecutive absorbent sheet products. That type of parallel lane or web arrangement is described for example in U.S. Pat. No. 6,213,346.

The invention also contemplates the use of the novel stack of absorbent sheet products in a variety of dispensers. One example is a dispenser having a downwardly-directed opening, such as that described in commonly-owned co-pending application ser. No. 10/660,659, the entirety of which is hereby expressly incorporated by reference. Other examples are dispensers having an upwardly directed opening, or a lateral opening. A dispenser having an upwardly directed opening and suited for dispensing the absorbent sheet products according to the invention is described in commonly-owned U.S. Pat. No. 7,178,689, the entirety of which is hereby expressly incorporated by reference.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

What is claimed is:

1. A stack of interfolded absorbent sheet products, comprising a plurality of absorbent sheets, wherein each sheet comprises a first fold that is offset from a line bisecting said sheet substantially parallel to said first fold, and an interfolding fold intersecting said first fold, wherein said first fold, said interfolding fold, and outer edges of each of the absorbent sheets define boundaries for four panels, with the panels on opposing sides of the first fold having different lengths and contacting each other within the stack, and wherein each of said absorbent sheets within said stack comprises at least one pair of panels sandwiched between a pair of adjacent panels of another of said absorbent sheets within said stack.

2. The stack of absorbent sheet products according to claim 1, wherein said first and second folds define four panels of equal width, two of said panels being of a first length and two of said panels being of a second length greater than said first length.

3. The stack of absorbent sheet products according to claim 2, wherein adjacent sheets are interfolded so as to overlap in a direction of said equal width, such that each absorbent sheet with said stack overlaps each adjacent sheet by an approximately equal extent.

4. The stack of absorbent sheet products according to claim 2, wherein the first fold is located such that the second length is at most about three times the first length and at least about 1.1 times the first length.

5. The stack of absorbent sheet products according to claim 2, wherein the first fold is located such that the second length is at most about twice the first length and at least about 1.3 times the first length.

6. The stack of absorbent sheet products according to claim 1, wherein each of said absorbent sheets has folded dimensions of approximately 4.25" by 6.5".

7. The stack of absorbent sheet products according to claim 1, wherein each of said absorbent sheets has unfolded dimensions of approximately 8.5" by 11".

8. The stack of absorbent sheet products according to claim 1, wherein each said sheet is folded such that offset portions of said sheet are positioned interiorly of said sheet when folded.

9. The stack of absorbent sheet products according to claim 1, wherein each said sheet is folded such that offset portions of said sheet are positioned exteriorly of said sheet when folded.

10. The stack of interfolded absorbent sheet products according to claim 1, wherein each of said absorbent sheets is a single ply paper napkin having a basis weight of from about 10 to 20 lb.

11. The stack of interfolded absorbent sheet products according to claim 10, wherein said basis weight is about 13 lb.

12. The stack of interfolded absorbent sheet products according to claim 1, wherein each napkin within said stack receives between two inwardly facing adjacent panels a pair of adjacent panels from each of two napkins disposed respectively above and below said napkin in said stack.

13. The stack of interfolded absorbent sheet products according to claim 1, wherein each of said absorbent sheets is entirely detached from all other absorbent sheets within said stack.

14. The stack of interfolded absorbent sheet products according to claim 1, wherein each of said absorbent sheets is attached by tabs to one or two other absorbent sheets within said stack.

15. The stack of interfolded absorbent sheet products according to claim 1, wherein each of said absorbent sheets bears an embossed surface relief applied by embossing rollers during a converting phase of manufacturing said absorbent sheet products.

16. The stack of interfolded absorbent sheet products according to claim 1, wherein each of said absorbent sheets is through air dried (TAD) tissue or structure or textured tissue, made using a process a using pressure, vacuum, or air flow through the wet web, each of said absorbent sheets having an air side and a fabric side.

17. The stack of interfolded absorbent sheet products according to claim 15, wherein said embossed surface relief is of a continuous pattern over an entire surface of said absorbent sheets.

18. The stack of interfolded absorbent sheet products according to claim 15, wherein said embossed surface relief is applied only along a peripheral region of said absorbent sheets.

19. The stack of interfolded absorbent sheet products according to claim 15, wherein said embossed surface relief pattern comprises relief elements that project from one side of each absorbent sheet and are recessed relative to an opposite side of each absorbent sheet, each absorbent sheet being folded such that exterior panels of each absorbent sheet when folded comprise said relief elements that are recessed relative to said opposite side of each absorbent sheet.

20. The stack of interfolded absorbent sheet products according to claim 16, wherein each absorbent sheet is folded such that exterior panels of each absorbent sheet when folded comprise said fabric side of each absorbent sheet.

* * * * *